United States Patent [19]

Hungerford

[11] Patent Number: 4,651,544

[45] Date of Patent: Mar. 24, 1987

[54] EXTERIOR ENTRY DOOR TETHERED KEY SAFE

[76] Inventor: Robert E. Hungerford, 116 Lake Desire Dr. North, Renton, Wash. 98055

[21] Appl. No.: 661,402

[22] Filed: Oct. 16, 1984

[51] Int. Cl.[4] ..... E05B 65/00

[52] U.S. Cl. ..... 70/63; 70/279; 109/48; 109/50; 109/57

[58] Field of Search ..... 70/279, 456 R, 63; 109/45, 46, 48, 50, 52, 54, 57; 220/210

[56] References Cited

U.S. PATENT DOCUMENTS

| | | | |
|---|---|---|---|
| 2,022,381 | 11/1935 | Mosler et al. | 109/46 |
| 2,813,620 | 11/1957 | Hansen | 70/63 X |
| 3,084,008 | 4/1963 | Mallett | 70/63 X |
| 3,695,067 | 10/1972 | Bays | 70/63 |
| 3,712,091 | 1/1973 | Parent | 70/63 |
| 3,867,823 | 2/1975 | Waltower | 70/63 X |
| 3,934,434 | 1/1976 | Law | 70/63 |
| 3,979,932 | 9/1976 | Piche | 70/63 |
| 4,325,240 | 4/1982 | Gable | 70/63 X |

*Primary Examiner*—Gary L. Smith
*Assistant Examiner*—Lloyd A. Gall

[57] ABSTRACT

A tamperproof key safe for guest rooms of motels comprises a mounting bracket surrounded by a containment box having a hinged compartment rotatable to an open position for providing access to a tethered room key. An electronic press key calculator actuates a solenoid operated release mechanism, or a rotatable mechanical latch may be used for partially releasing the hinged compartment and accessing the room key. Further rotation of the mechanical latch provides access to the interior of the key safe for making inspections and repairs.

4 Claims, 5 Drawing Figures

EXTERIOR ENTRY DOOR TETHERED KEY SAFE

BACKGROUND OF THE INVENTION

When guests check into condominiums, motels, and/or hotels, today they are given a special key for their assigned room, which is returned upon their checking out. Some time the room keys are stolen, lost, or duplicated. This is also true of the master key to all of the rooms. The subsequent necessary replacement of either the key or the whole lock assembly is an expensive and time consuming operation. Moreover when a person wants to go touring or to play on the beach, their handling of a set of keys are a problem. The keys could be lost to a burglar. Later the burglar would gain access to the room, if the hotel is identified on the key chain. Also some resorts do not have a clerk on duty after hours, so an emergency number must be called in case of lost keys. Also, some resorts, condominiums, motels and/or hotels will house more than one couple in a unit of rooms. If any person wants to return to the unit and doesn't have a key, then a key must be obtained from another member of the group. This is immediately impossible some times. For an example; if the guests are snow skiing, two persons will take different skiing routes, and one person, returning earlier, must wait for the other person having the key to return. Additionally if a person is delayed past the check in time, then the operator of the guest facilities must be called out of bed to check in these guests after hours.

Any attempts to eliminate these key inconveniences associated with resorts, condominiums, motels and hotels are not presently known. However, it is known that when persons working with a real estate business or a vehicle sales business are showing the homes or vehicles to customers, they carry a key and/or combination to be used to gain access to a key safe which contains the specific key of a home or a vehicle.

By way of example, Harry Mallett in his U.S. Pat. No. 3,084,008 of 1963, discloses his Automatic Locking Key Safe, which is secured to a dwelling to contain a spring retractable tethered specific key to a dwelling. The real estate salesperson uses his or her real estate business key to gain access to the interior of this key safe and then to the tethered specific key to the dwelling.

Derek Gable in his U.S. Pat. No. 4,325,240 to 1982 illustrates and describes his Locking Mechanism, which is useful to real estate persons, vehicle sales persons, and others of like groups, you must gain access to dwellings or vehicles by specific dwelling keys or specific vehicle keys. These specific keys are placed inside his locking mechanism and secured, only to be released if such a person has a special key formed to mechanically correspond to a key insert cavity, that in turn is equipped with an interior that is changeable upon the turning of components directly associated with a combination locking mechanism. Therefore the holder of the special key must also know the combination to gain entry to the locking mechanism structure, which includes a compartment in which a specific dwelling key, or a specific vehicle key is kept. Several combinations of keys and combinations may be in use during a like time period.

Paul E. Piche in his U.S. Pat. No. 3,979,932 of 1975, illustrates and describes his Adjustable Combination Lock Key Safe, which is secured to the door handle of a dwelling. Two telescoping parts are used in conjunction with a shackle to enclose a specific dwelling key. Access to key safe is undertaken by operating a combination lock, which locks the telescoping parts together. After reaching the successful combination, a separate latch is rotatable to release the telescoping parts from one another.

Jack Law, in his U.S. Pat. No. 3,934,434 of 1976 discloses his Key Safe Apparatus which contains a specific residence key, which is only obtainable by a real estate person correctly operating a combination lock which holds the components of the key safe together.

Carl Hansen in his U.S. Pat. No. 2,813,620 illustrates and describes his Container for Keys, Sales Information, and the Like, which contains a specific dwelling key, or which contains a specific vehicle key. This specific key is only available, if the authorized salesperson has a key to open Mr. Hansen's container.

Ronald Parent in his U.S. Pat. No. 3,712,091 of 1973 illustrates and describes his Method and Device for Handling Motor Vehicle Keys. A master key is used by car salespersons to open his device to gain access to a specific ignition key to the car on which the device is also locked.

Robert Bays in his U.S. Pat. No. 3,695,067 of 1972, discloses his Car Theft Prevention Device which is similar in purpose to Ronald Parent's device.

Although these prior inventors concerned themselves with controlling the access to specific keys for dwellings and/or vehicles, none of them apparently concerned themselves with solving the inconveniences encountered by guests and/or members of the staff of resorts, condominiums, motels and hotels. There remained a need for other embodiments of specific key safes and the locks thereof.

SUMMARY

To provide key safes to safely kept specific room keys adjacent to the specific locks of specific rooms or units of resorts, condominiums, motels and/or hotels, a three major part key safe is provided with two independent entry locks. One is a master key controlled by the staff of the guest entertaining premise, which gains entry to a larger interior volume of the key safe, to reach a tethered specific room key, and to unfasten major parts or service or interchange. The interchange involves moving an entire key safe except for its mounting bracket to a new location. The servicing includes resetting a combination for a room guest's use, resetting a combination for a service maid's use, replacing electrical components such as electronic calculator drive of the combination unit, the battery or solar collector therefore, or replacing the locking door solenoid thereof, the tethered key mechanism, or the tilting compartment for the specific room key. This tilting compartment is the smaller interior volume which is only accessible to the room guests to enable them, upon reaching the right combination specifically assigned to them to gain access to their specific room key.

This key safe also referred to as an entry key containment box, having an electronic combination lock operation preferably powered by a solar charged battery eliminates all needs for guests and service maids, cleaning persons, maintenance persons, to carry keys. By keeping the well tethered, retractable tether, specific key always adjacent the specific room, the specific key is not to be lost. There will be no more lost, misplaced, or carried away specific room keys. New guests will each be given a new combination upon their reservation confirmation, so guests may go directly to their rooms, especially upon late arrival, and then complete their check in during the regular office hours. Each guest staying in a specific room during the same reservation period will know the combination, thereby gaining access at his or her own selected time of entry during each twenty four hour period. When their reservation time is over, the designated staff person resets the combination via use of a very special master key. This key is also used for the repair and servicing of this key safe.

Where guests may also be assigned rental cars a similar key safe is used in conjunction with the guests' rental of these cars. Then like advantages are realized. If the guests go directly on foot to a beach or first travel by their rental car, they must only remember their personally assigned combination numbers. They and the management personnel are freed of the hassles of handling the specific keys to specific locks of specific guest rooms and specific rental cars.

BRIEF DESCRIPTION OF THE DRAWINGS

The exterior entry door tethered key safe or containment box is illustrated in the drawings, wherein.

DESCRIPTION OF A PREFERRED EMBODIMENT

Figure 1:
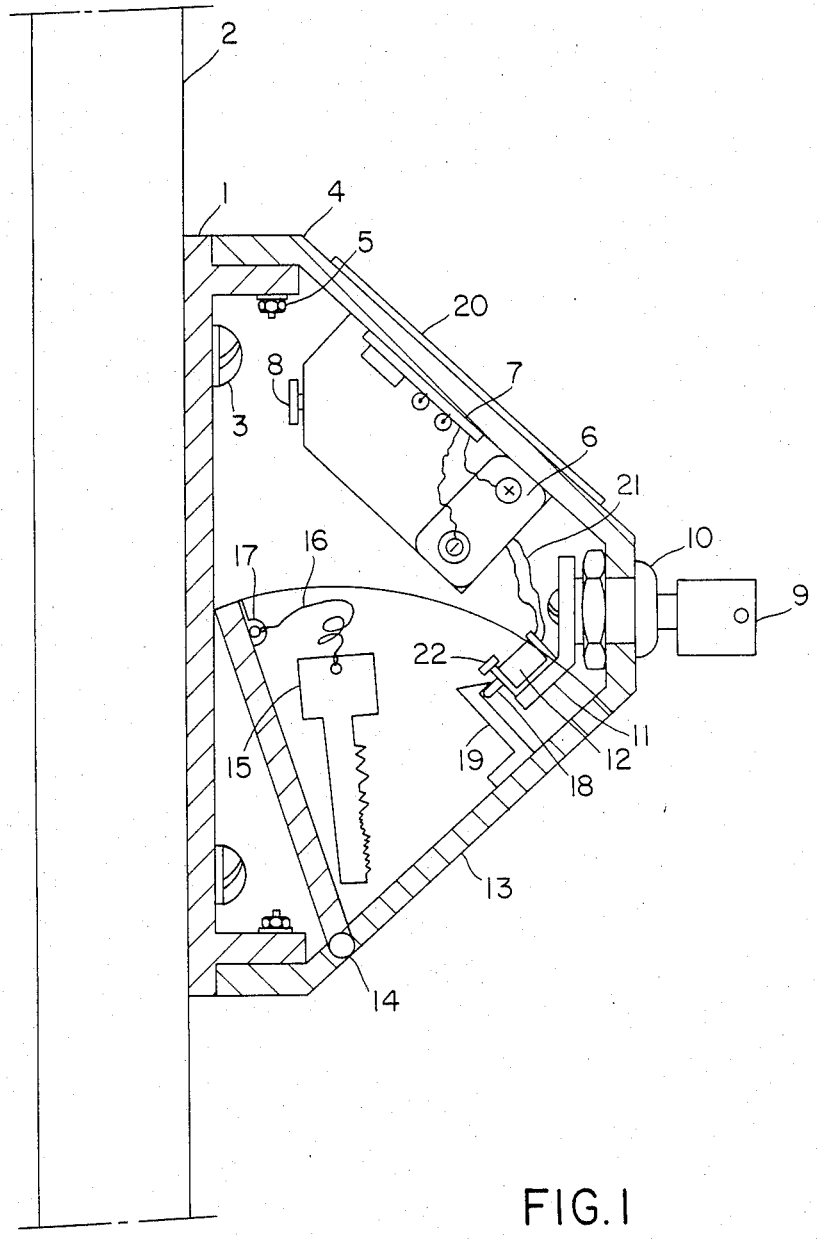
FIG. 1 is a side view with portions broken away to show the interior arrangement of the components, whereby electronic calculator combination components with a solenoid, upon a designated combination being reached, partially releases a tethered retractable specific room key compartment, permitting only access to the specific room key by the guests or service maid who know their respective assigned combinations, and whereby a specific key manipulated by a designated staff person fully releases the tethered retractable specific room key compartment to gain access to the full interior to change the respective combinations, to service, to repair, or to remove this key safe.

In FIG. 1 of the drawings of this electrical combination and key operated door entry specific key safe or containment box used at resorts, condominiums, motels and hotels, the interrelated components are illustrated in their locked positions. The mounting bracket 1 is secured to the outside room entry door 2 by mounting screws 3.

Figure 3:
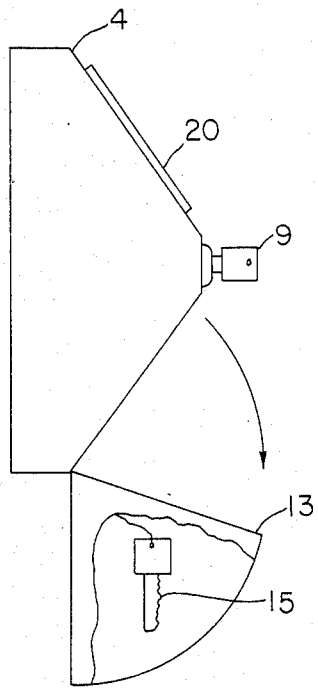
FIG. 3 is a side view of the key safe showing the tethered retractable specific room key compartment in its fully released position, so a designated staff person may gain access to the full interior.

Before the weatherproof and temperature resistant key containment box 4 is secured in place, with fasteners 5, an installer first connects battery 6 to the electronics assembly 7. Then the installer programs the electrical combination to be used of the electronics assembly 7, via its three rotary switches 8. Next, master key 9 is inserted in lock 10 and rotated counterclockwise 90 degrees. This in turn rotates cam 11 and solenoid 12 out of the way of tethered, retractable specific room key compartment 13 and allows key compartment 13 to swing into the fully released position shown in FIG. 3, via hinge 14, shown in FIG. 1. Now the specific room door entry key 15 is tethered by attachment to the self coiling lanyard 16, which is attached to key compartment 13 by clamp 17. The containment box 4 now is placed over mounting bracket 1, and is bolted into place by containment box mounting bolts designated as fasteners 5. Thereafter, the master key 9 is rotated 90 degrees clockwise and removed from lock 10. Key compartment 13 is then pushed closed.

Figure 5:
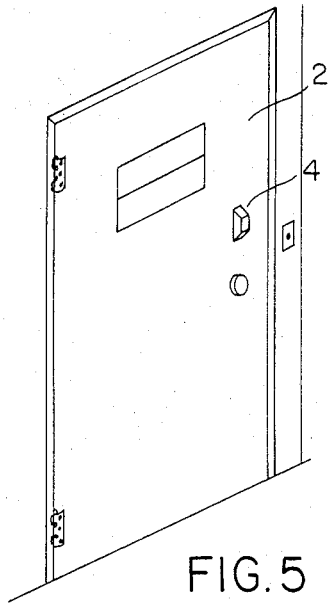
FIG. 5 is a partial perspective view of how the key safe or containment box is mounted on a door of a guest room nearby the specific door lock of this guest room.
Figure 4:
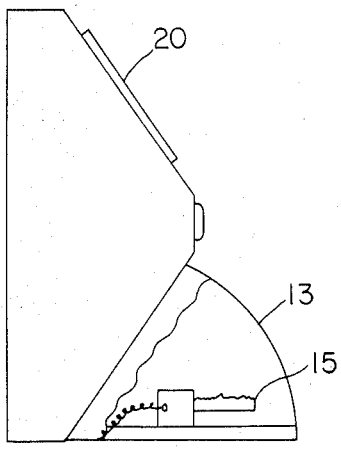
FIG. 4 is a side view of the key safe illustrating the tethered retractable specific room key compartment in its partially released position, so only a designated guest or a designated service maid may reach the tethered specific room key.

Now the electrical combination operated door entry specific key safe or containment box is ready for use. The operator, either the room guest or the service maid, with the knowledge of the electrical combination, enters the combination via selected numerical push keys on board 20. If the correct combination is entered, a one second pulsed signal is sent through solenoid wires 21 to solenoid 12. Then its solenoid plunger 18 is pulled up inside solenoid 12, thereby clearing the key compartment latch 19, and the key compartment 13 is partially released opening to the position shown in FIG. 4, providing access to the specific key to the room lock. Because the back side of key compartment 13 comes in contact with key compartment stop 22 the key compartment 13 is not released farther to allow access to the balance of the interior. The door entry key 15 is now pulled from key compartment 13 and is used to unlock the lock of entry door knob 23 shown in FIGS. 2 and 5. After the entry door of the guest room is opened, then door entry key 15 is removed from the lock of the entry door knob 23, and this specific key is automatically pulled back into key compartment 13 by the self coiling lanyard 16. After the door entry specific key 15 is back inside key compartment 13, the key compartment 13 is closed, securely retaining this important specific key 15, until the combination, or newly selected combination is accurately undertaken so a guest or a service maid may gain access to this specific key 15.

The electronics 7 is preferably selected from available components whereby it has the capacity of having two resettable combinations. One combination is resettable with respect to the changing of the guests with respect to different reservation times. The other combination is resettable with respect to changing the room assignments to respective service maids. The master keys are highly controlled with respect to the members of the staff to whom they are entrusted.

Figure 2:
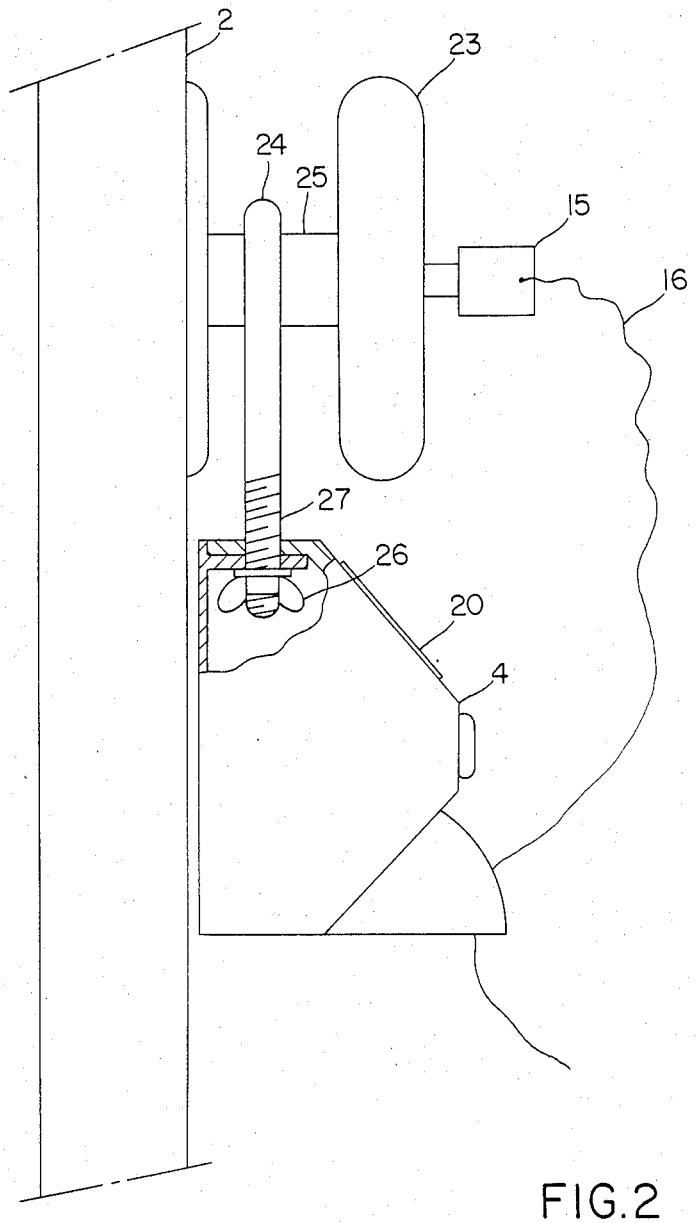
FIG. 2 is a side view, with some portions broken away to illustrate the shackle, of the key safe in an embodiment arranged to be secured to the door handle of the room, or via indication to a door handle of a vehicle, in contrast to a key safe being secured to a panel door, or wall structure, as shown in FIG. 1.

These selected staff members insert the master key 9 in lock 10, and turn the key 9 in a 45 degree counterclockwise rotation to swing the cam 11, the solenoid 12, and solenoid plunger 18, out of contact with key compartment latch 19. Then the key compartment 13 swings open, thereby allowing the use of door entry specific key 15. If more than just room entry is desired, then the master key 9 is rotated farther around to 90 degrees counter-clockwise, to swing the key compartment stop 22 out of the way. Thereafter the key compartment 13 is fully released to the open position shown in FIG. 3. The selected staff member then has several choices. He or she may remove the containment box 4 from mounting bracket 1, repair the electronics 7, change the batteries 6, or change the electrical combinations, by changing the rotary switches 8. In FIGS. 1 and 5, this exterior entry door tethered key safe or containment box assembly 30 is illustrated as being secured to a door 2 structure or a wall structure. However, as shown in FIG. 2, the door entry specific key containment box assembly or key safe 30 is equipped with an optional shackle 24, which is attached around the hub 25 of entry door knob 23. This shackle 24 is first placed around the hub 25. Then the two threaded ends 27 of shackle 24 are inserted into the top of containment box 4 and secured in place by wing nuts 26. The subsequent operations are undertaken in the same way as they were previously explained, when the guests and service maids employ their respectively assigned combinations, and the selected staff members use the special key.

I claim:

1. A weatherproof and temperature resistant exterior entry door tethered key safe for guest rooms of condominiums, motels, and hotels, for securement to structure nearby the outside lock of the entry door of the guest room, comprising:

(a) a mounting bracket for securement to the structure nearby the outside lock;

(b) a surrounding containment box for securement to the mounting bracket having a means to gain access to its interior, and to a specific room key receiving compartment;

(c) fasteners to secure the mounting bracket to the structure and to secure the surrounding containment box to the mounting bracket;

(d) a specific room key receiving compartment secured to the surrounding containment box;

(e) a tether to keep the specific room key connected to the key safe;

(f) an electrical, mechanical assembly, battery powered, secured to the interior of the key safe, having selectable press keys of an electronic calculator, available at the exterior of the key safe, an electronic calculator selectably and changeably programmed to different press key combinations, having a solenoid operated latch to gain access to the specific room key receiving compartment, whereby room guests specifically assigned to a selected press key combination may gain access to the specific room key;

(g) an assembly of special key lockable movable latch components secured to the surrounding containment box having a locked position, a first released position, and a second release position, whereby a staff person assigned to a special key may unlock the key safe to a first release position, whereby the means is actuated to gain access to the specific room key receiving compartment, independent of any operation of the electrical, mechanical assembly, and whereby the staff member may further unlock the key safe to a second release position, whereby the means is actuated to gain access to the interior of the key safe, so the staff member may change the combination, make an inspection, make replacements, make repairs, and remove the containment box from the mounting bracket.

2. A weatherproof and temperature resistant exterior entry door tethered key safe for guest rooms, as claimed in claim 1, wherein the electronic calculator is capable of being selectably and changeably programmed to create two sets of different press key combinations, each having the potential of sending a pulse to operate the solenoid operated latch, whereby the room guests, per each reservation time, are assigned their selected combination, and whereby each room maid is assigned her selected combination per her working period.

3. A weatherproof and temperature resistant exterior entry door tethered key safe for guest rooms of condominiums, motels, and hotels for mounting on door and wall structures, comprising:

(a) a mounting bracket serving as the complete back of the key safe and having recesses to receive fasteners securing it to a structure, and having a receiving flange with recesses to receive fasteners adapted to secure its receiving flange to a surrounding containment box, which with the mounting bracket completes the interior volume of the key safe;

(b) a surrounding containment box having an overlapping flange to fit over the receiving flange of the mounting bracket, having an outwardly openable lower positioned specific room key containing open top compartment, having a hinge mounting for this compartment permitting it to rotate downwardly to provide access to the room key, and having fasteners to secure the overlapping flanges together;

(c) an assembly of electrical and mechanical components mounted on the interior of the containment box clear of the pivotal movement of the open top compartment, except for a solenoid operated release mechanism and a stop abutment of this assembly, and other components of this assembly being a press key electronic calculator set to a selected changeable combination to be subsequently assigned to a room guest to gain access to the specific room key, and set to a selected changeable combination to be subsequently assigned to a room maid to gain access to the specific room key, a recoilable tether for the specific room key to always return this key to this open top compartment, a battery source of power to operate the electronic calculator and the solenoid operated release mechanism, and electrical circuits to conduct the pulse of electrical power released upon reaching the correct combination, whereby upon the correct entry of a combination the solenoid release mechanism operates, so the open top specific key compartment partially releases, by pivoting on its hinge, until reaching the stop abutment at which position its open top provides access to the tethered specific room key, until it is retracted and this key compartment is then pivoted back into its closed position and so held by the solenoid operated release mechanism; and (d) an assembly of special key lockable rotatable latch components having a rotatable latch mounted on the interior of the containment box adjacent the assembly of most of the electrical and mechanical components, and clear of the pivotal movement of the open top compartment, except for the rotatable latch, which positions the solenoid operated release mechanism to keep the open top compartment in its closed position, until the correct combination is completed to release the elecrical power to this solenoid operated release, yet this rotatable latch, independently of the electrical components, upon turning of the special key through a selected number of degrees moves the solenoid operated release mechanism clear of the open top compartment, so this compartment will be partially released, by pivoting on its hinge, until reaching the stop abutment, at which position its open top provides access to the tethered specific room key to a person on the staff of the condominium, motel, or hotel so designated to have this special key, and then if required, this special key is used to continue the rotation through a selected number of degrees of the lockable rotatable latch components to clear the stop abutment from the rotating path of the open top compartment holding the specific room key, so this compartment sufficiently clears the remaining portions of the containment box, whereby a person on the staff gains access to the interior of the key safe to change the respective combinations used by the room guests and the room maids, to make an inspection, to make repairs, to make replacements, and to remove the containment box from the mounting bracket.

4. A weatherproof and temperature resistant exterior entry door tethered key safe for guest rooms, as claimed in claim 3, comprising, in addition a shackle subassembly serving to mount this key safe to the hub of a doorknob, comprising a threaded shackle curved bolt to place about the hub and down through holes in the overlapping flanges of the mounting bracket and the surrounding containment box, entering into the interior of the key safe, and fasteners within the key safe to secure the threaded shackle curved bolt in place.

* * * * *